US010734003B2

(12) United States Patent
Wang

(10) Patent No.: US 10,734,003 B2
(45) **Date of Patent: *Aug. 4, 2020**

(54) NOISE SIGNAL PROCESSING METHOD, NOISE SIGNAL GENERATION METHOD, ENCODER, DECODER, AND ENCODING AND DECODING SYSTEM

(71) Applicant: Huawei Technologies Co., Ltd., Shenzhen (CN)

(72) Inventor: Zhe Wang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/168,252

(22) Filed: Oct. 23, 2018

(65) Prior Publication Data

US 2019/0057704 A1 Feb. 21, 2019

Related U.S. Application Data

(63) Continuation of application No. 15/662,043, filed on Jul. 27, 2017, now Pat. No. 10,134,406, which is a (Continued)

(30) Foreign Application Priority Data

Apr. 8, 2014 (CN) ..... 2014 1 0137474

(51) Int. Cl.
*G10L 19/00* (2013.01)
*G10L 19/012* (2013.01)
(Continued)

(52) U.S. Cl.
CPC ..... *G10L 19/012* (2013.01); *G10L 19/06* (2013.01); *G10L 19/08* (2013.01); *G10L 19/26* (2013.01); *G10L 19/02* (2013.01); *G10L 19/032* (2013.01)

(58) Field of Classification Search
CPC ..... G10L 19/012; G10L 19/028; G10L 21/02
(Continued)

(56) References Cited

U.S. PATENT DOCUMENTS 5,960,389 A 9/1999 Jarvinen et al.
6,108,623 A 8/2000 Morel
(Continued)

FOREIGN PATENT DOCUMENTS

CN 1194507 A 9/1998
CN 1194553 A 9/1998
(Continued)

OTHER PUBLICATIONS

Foreign Communication From a Counterpart Application, Japanese Application No. 2018-128182, Japanese Office Action dated Jul. 29, 2019, 3 pages.
(Continued)

*Primary Examiner* — Daniel Abebe
(74) *Attorney, Agent, or Firm* — Conley Rose, P.C.

(57) ABSTRACT

A linear prediction-based noise signal processing method, includes obtaining a linear prediction coefficient of the noise signal, filtering a signal derived from the noise signal based on the linear prediction coefficient in order to obtain a linear prediction residual signal, obtaining excitation energy of the linear prediction residual signal and a spectral envelope of the linear prediction residual signal, and the spectral envelope, the excitation energy and the linear prediction coefficient are encoded.

20 Claims, 7 Drawing Sheets

Related U.S. Application Data continuation of application No. 15/280,427, filed on Sep. 29, 2016, now Pat. No. 9,728,195, which is a continuation of application No. PCT/CN2014/008169, filed on Oct. 9, 2014.

(51) Int. Cl.

| | |
|---|---|
| ***G10L 19/08*** | (2013.01) |
| ***G10L 19/06*** | (2013.01) |
| ***G10L 19/26*** | (2013.01) |
| *G10L 19/02* | (2013.01) |
| *G10L 19/032* | (2013.01) |

(58) Field of Classification Search

USPC ..... 704/226

See application file for complete search history.

(56) References Cited

U.S. PATENT DOCUMENTS

| | | | | |
|---|---|---|---|---|
| 6,163,608 | A | 12/2000 | Romesburg et al. | |
| 6,424,939 | B1 * | 7/2002 | Herre | G10L 19/028 704/219 |
| 6,606,593 | B1 | 8/2003 | Jarvinen et al. | |
| 6,782,361 | B1 | 8/2004 | El-Maleh et al. | |
| 7,912,712 | B2 | 3/2011 | Shlomot et al. | |
| 8,767,974 | B1 | 7/2014 | Lu et al. | |
| 9,263,051 | B2 * | 2/2016 | Vos | G10L 19/04 |
| 2002/0052736 | A1 | 5/2002 | Kim et al. | |
| 2002/0120439 | A1 | 8/2002 | Mekuria et al. | |
| 2003/0093270 | A1 | 5/2003 | Domer | |
| 2004/0133419 | A1 | 7/2004 | El-Maleh et al. | |
| 2010/0191522 | A1 | 7/2010 | Zhang et al. | |
| 2010/0324917 | A1 | 12/2010 | Shlomot et al. | |
| 2013/0332176 | A1 | 12/2013 | Setiawan et al. | |
| 2013/0339036 | A1 | 12/2013 | Baeckstroem et al. | |
| 2014/0303967 | A1 | 10/2014 | Jeong et al. | |
| 2016/0133264 | A1 | 5/2016 | Mani et al. | |
| 2016/0155457 | A1 | 6/2016 | Bruhn | |

FOREIGN PATENT DOCUMENTS

| | | | |
|---|---|---|---|
| CN | 1200000 | A | 11/1998 |
| CN | 1514998 | A | 7/2004 |
| CN | 101193090 | A | 6/2008 |
| CN | 101303855 | A | 11/2008 |
| CN | 101335003 | A | 12/2008 |
| CN | 101651752 | A | 2/2010 |
| CN | 102136271 | A | 7/2011 |
| CN | 102664003 | A | 9/2012 |
| CN | 102760441 | A | 10/2012 |
| CN | 103093756 | A | 5/2013 |
| CN | 103680509 | A | 3/2014 |
| JP | H10190498 | A | 7/1998 |
| JP | 2004517348 | A | 6/2004 |
| JP | 2014510307 | A | 4/2014 |
| KR | 20130126711 | A | 11/2013 |
| WO | 0233695 | A2 | 4/2002 |
| WO | 2013062201 | A1 | 5/2013 |

OTHER PUBLICATIONS

Foreign Communication From a Counterpart Application, Japanese Application No. 2018-128182, English Translation of Japanese Office Action dated Jul. 29, 2019, 3 pages.

Machine Translation and Abstract of Chinese Publication No. CN1194553, Sep. 30, 1998, 16 pages.

Machine Translation and Abstract of Chinese Publication No. CN1200000, Nov. 25, 1998, 34 pages.

Machine Translation and Abstract of Chinese Publication No. CN101193090, Jun. 4, 2008, 15 pages.

Machine Translation and Abstract of Chinese Publication No. CN101303855, Nov. 12, 2008, 18 pages.

Machine Translation and Abstract of Chinese Publication No. CN101651752, Feb. 17, 2010, 36 pages.

Machine Translation and Abstract of Chinese Publication No. CN102136271, Jul. 27, 2011, 32 pages.

Machine Translation and Abstract of Chinese Publication No. CN102664003, Sep. 12, 2012, 13 pages.

Machine Translation and Abstract of Chinese Publication No. CN102760441, Oct. 31, 2012, 32 pages.

Machine Translation and Abstract of Chinese Publication No. CN103093756, May 8, 2013, 14 pages.

Machine Translation and Abstract of Chinese Publication No. CN103680509, Mar. 26, 2014, 12 pages.

Machine Translation and Abstract of Korean Publication No. KR20130126711, Nov. 20, 2013, 24 pages.

"3rd Generation Partnership Project; Technical Specification Group Services and System Aspects; Speech codec speech processing functions; Adaptive Multi-Rate—Wideband (AMR-WB) speech codec; Comfort noise aspects (Release 6)," 3GPP TS 26.192, V6.0.0, Dec. 2004, 14 pages.

Song, Z., "Application of Matlab in Speech Signal Analysis and Synthesis," Beijing University of Aeronautics and Astronautics, 2013, 2 pages.

English Translation of Song, Z., "Application of Matlab in Speech Signal Analysis and Synthesis," Beijing University of Aeronautics and Astronautics, 2013, 1 pages.

Benyassine, A., et al. "ITU-T Recommendation G. 729 Annex B: A Silence Compression Scheme for Use with G.729 Optimized for V.70 Digital Simultaneous Voice and Data Applications," IEEE Communications Magazine, Sep. 1997, pp. 64-73.

"Digital cellular telecommunications system (Phase 2+); Universal Mobile Telecommunications System (UMTS); LTE; Speech codec speech processing functions; Adaptive Multi-Rate—Wideband (AMR-WB) speech codec; Source aontrolled rate operation (3GPP TS 26.193 version 11.0.0 Release 11)," ETSI TS 126 193, V11.0.0, Oct. 2012, 23 pages.

El-Maleh, K., "Classification-Based Techniques for Digital Coding of Speech-plus-Noise," XP55358220, Jan. 2004, 152 pages.

Foreign Communication From a Counterpart Application, Chinese Application No. 2014101374740, Chinese Search Report dated Jan. 24, 2018, 2 pages.

Foreign Communication From a Counterpart Application, Chinese Application No. 201410137474.0, Chinese Office Action dated Feb. 2, 2018, 8 pages.

Foreign Communication From a Counterpart Application, Korean Application No. 1020167026295, Korean Notice of Allowance and Brief Translation dated Mar. 12, 2018, 3 pages.

Foreign Communication From a Counterpart Application, European Application No. 14888957.9, Extended European Search Report dated Apr. 7, 2017, 7 pages.

Foreign Communication From a Counterpart Application, Korean Application No. 10-2016-7026295, Korean Office Action dated Jul. 28, 2017, 8 pages.

Foreign Communication From a Counterpart Application, Korean Application No. 10-2016-7026295, Translation of Korean Office Action dated Jul. 28, 2017, 4 pages.

Foreign Communication From a Counterpart Application, Japanese Application No. 2017-503044, Japanese Office Action dated Oct. 3, 2017, 3 pages.

Foreign Communication From a Counterpart Application, Japanese Application No. 2017-503044, English Translation of Japanese Office Action dated Oct. 3, 2017, 3 pages.

Foreign Communication From a Counterpart Application, PCT Application No. PCT/CN2014/088169, English Translation of International Search Report dated Jan. 16, 2015, 3 pages.

Foreign Communication From a Counterpart Application, PCT Application No. PCT/CN2014/088169, English Translation of Written Opinion dated Jan. 16, 2015, 12 pages.

"Universal Mobile Telecommunications System (UMTS); LTE; EVS Codec Detailed Algorithmic Description (3GPP TS 26.445 version 12.0.0 Release 12)," ETSI TS 126 445, V12.0.0, Nov. 2014, 627 pages.

(56) References Cited

OTHER PUBLICATIONS

"Universal Mobile Telecommunications System (UMTS); LTE; EVS Codec Comfort Noise Generation (CNG) Aspects (3GPP TS 26.449 version 12.0.0 Release 12)," ETSI TS 126 449, V12.0.0, Oct. 2014, 10 pages.

* cited by examiner

NOISE SIGNAL PROCESSING METHOD, NOISE SIGNAL GENERATION METHOD, ENCODER, DECODER, AND ENCODING AND DECODING SYSTEM

CROSS-REFERENCE TO RELATED APPLICATIONS

This patent application is a continuation of U.S. patent application Ser. No. 15/662,043 filed on Jul. 27, 2017, which is a continuation of U.S. patent application Ser. No. 15/280,427 filed on Sep. 29, 2016, which is now U.S. Pat. No. 9,728,195, which is a continuation of International Patent Application No. PCT/CN2014/088169 filed on Oct. 9, 2014, which claims priority to Chinese Patent Application No. 201410137474.0 filed on Apr. 8, 2014. All of the aforementioned patent applications are hereby incorporated by reference in their entireties.

TECHNICAL FIELD

The present disclosure relates to the audio signal processing field, and in particular, to a noise processing method, a noise generation method, an encoder, a decoder, and an encoding and decoding system.

BACKGROUND

There is speech in approximately only 40% of time of voice communication, and there is silence or background noise (collectively referred to as background noise below) in all other time. To reduce transmission bandwidth of the background noise, a discontinuous transmission (DTX) system and a comfort noise generation (CNG) technology appear.

DTX means that an encoder intermittently encodes and sends an audio signal in a background noise period according to a policy, instead of continuously encoding and sending an audio signal of each frame. Such a frame that is intermittently encoded and sent is generally referred to as a silence insertion descriptor (SID) frame. The SID frame generally includes some characteristic parameters of background noise, such as an energy parameter and a spectrum parameter. On a decoder side, a decoder may generate consecutive background noise recreation signals according to a background noise parameter obtained by decoding the SID frame. A method for generating consecutive background noise in a DTX period on the decoder side is referred to as CNG. An objective of the CNG is not accurately recreating a background noise signal on an encoder side, because a large amount of time-domain background noise information is lost in discontinuous encoding and transmission of the background noise signal. The objective of the CNG is that background noise that meets a subjective auditory perception requirement of a user can be generated on the decoder side, thereby reducing discomfort of the user.

In an existing CNG technology, comfort noise is generally obtained using a linear prediction-based method, that is, a method for using random noise excitation on a decoder side to excite a synthesis filter. Although background noise can be obtained using such a method, there is a specific difference between generated comfort noise and original background noise in terms of subjective auditory perception of a user. When a continuously encoded frame is transited to a comfort noise frame, such a difference in the subjective perception of the user may cause subjective discomfort of the user.

A method for using CNG is stipulated in the adaptive multi-rate wideband (AMR-WB) standard in the 3rd Generation Partnership Project (3GPP), and a CNG technology of the AMR-WB is also based on linear prediction. In the AMR-WB standard, a SID frame includes a quantized background noise signal energy coefficient and a quantized linear prediction coefficient, where the background noise energy coefficient is a logarithmic energy coefficient of background noise, and the quantized linear prediction coefficient is expressed by a quantized immittance spectral frequency (ISF) coefficient. On a decoder side, energy and a linear prediction coefficient that are of current background noise are estimated according to energy coefficient information and linear prediction coefficient information that are included in the SID frame. A random noise sequence is generated using a random number generator, and is used as an excitation signal for generating comfort noise. A gain of the random noise sequence is adjusted according to the estimated energy of the current background noise such that energy of the random noise sequence is consistent with the estimated energy of the current background noise. Random sequence excitation obtained after the gain adjustment is used to excite a synthesis filter, where a coefficient of the synthesis filter is the estimated linear prediction coefficient of the current background noise. Output of the synthesis filter is the generated comfort noise.

In a method for generating comfort noise using a random noise sequence as an excitation signal, although relatively comfortable noise can be obtained, and a spectral envelope of original background noise can also roughly recovered, a spectral detail of the original background noise may be lost. As a result, there is still a specific difference between generated comfort noise and the original background noise in terms of subjective auditory perception. Such a difference may cause subjective auditory discomfort of a user when a continuously encoded speech segment is transited to a comfort noise segment.

SUMMARY

In view of this, in order to resolve the foregoing problem, embodiments of the present disclosure provide a noise signal processing method, a noise signal generation method, an encoder, a decoder, and an encoding and decoding system. According to the noise processing method, the noise generation method, the encoder, the decoder, and the encoding-decoding system that are in the embodiments of the present disclosure, more spectral details of an original background noise signal can be recovered such that comfort noise can be closer to original background noise in terms of subjective auditory perception of a user, a "switching sense" caused when continuous transmission is transited to DTX is relieved, and subjective perception quality of the user is improved.

A first aspect of the embodiments of the present disclosure provides a linear prediction-based noise signal processing method, where the method includes acquiring a noise signal, obtaining a linear prediction coefficient according to the noise signal, filtering the noise signal according to the linear prediction coefficient to obtain a linear prediction residual signal, obtaining a spectral envelope of the linear prediction residual signal according to the linear prediction residual signal, and encoding the spectral envelope of the linear prediction residual signal.

According to the noise signal processing method in this embodiment of the present disclosure, more spectral details of an original background noise signal can be recovered such that comfort noise can be closer to original background noise in terms of subjective auditory perception of a user, and subjective perception quality of the user is improved.

With reference to the first aspect of the embodiment of the present disclosure, in a first possible implementation manner of the first aspect of the embodiment of the present disclosure, after the obtaining a spectral envelope of the linear prediction residual signal according to the linear prediction residual signal, the method further includes obtaining a spectral detail of the linear prediction residual signal according to the spectral envelope of the linear prediction residual signal, and correspondingly, encoding the spectral envelope of the linear prediction residual signal includes encoding the spectral detail of the linear prediction residual signal.

With reference to the first possible implementation manner of the first aspect of the embodiment of the present disclosure, in a second possible implementation manner of the first aspect of the embodiment of the present disclosure, after filtering the noise signal according to the linear prediction coefficient to obtain a linear prediction residual signal, the method further includes obtaining energy of the linear prediction residual signal according to the linear prediction residual signal, and correspondingly, encoding the spectral detail of the linear prediction residual signal includes encoding the linear prediction coefficient, the energy of the linear prediction residual signal, and the spectral detail of the linear prediction residual signal.

With reference to the second possible implementation manner of the first aspect of the embodiment of the present disclosure, in a third possible implementation manner of the first aspect of the embodiment of the present disclosure, obtaining a spectral detail of the linear prediction residual signal according to the spectral envelope of the linear prediction residual signal includes obtaining a random noise excitation signal according to the energy of the linear prediction residual signal, and using a difference between the spectral envelope of the linear prediction residual signal and a spectral envelope of the random noise excitation signal as the spectral detail of the linear prediction residual signal.

With reference to the first possible implementation manner of the first aspect of the embodiment of the present disclosure and the second possible implementation manner of the first aspect of the embodiment of the present disclosure, in a fourth possible implementation manner of the first aspect of the embodiment of the present disclosure, obtaining a spectral detail of the linear prediction residual signal according to the spectral envelope of the linear prediction residual signal includes obtaining a spectral envelope of first bandwidth according to the spectral envelope of the linear prediction residual signal, where the first bandwidth is within a bandwidth range of the linear prediction residual signal, and obtaining the spectral detail of the linear prediction residual signal according to the spectral envelope of the first bandwidth.

With reference to the fourth possible implementation manner of the first aspect of the embodiment of the present disclosure, in a fifth possible implementation manner of the first aspect of the embodiment of the present disclosure, obtaining a spectral envelope of first bandwidth according to the spectral envelope of the linear prediction residual signal includes calculating a spectral structure of the linear prediction residual signal, and using a spectrum of a first part of the linear prediction residual signal as the spectral envelope of the first bandwidth, where a spectral structure of the first part is stronger than a spectral structure of another part, except the first part, of the linear prediction residual signal.

With reference to the fifth possible implementation manner of the first aspect of the embodiment of the present disclosure, in a sixth possible implementation manner of the first aspect of the embodiment of the present disclosure, the spectral structure of the linear prediction residual signal is calculated in one of the following manners, calculating the spectral structure of the linear prediction residual signal according to a spectral envelope of the noise signal, and calculating the spectral structure of the linear prediction residual signal according to the spectral envelope of the linear prediction residual signal.

With reference to the first possible implementation manner of the first aspect of the embodiment of the present disclosure, in a seventh possible implementation manner of the first aspect of the embodiment of the present disclosure, after obtaining a spectral detail of the linear prediction residual signal according to the spectral envelope of the linear prediction residual signal, the method further includes calculating a spectral structure of the linear prediction residual signal according to the spectral detail of the linear prediction residual signal, and obtaining a spectral detail of second bandwidth of the linear prediction residual signal according to the spectral structure, where the second bandwidth is within a bandwidth range of the linear prediction residual signal, and a spectral structure of the second bandwidth is stronger than a spectral structure of another part of bandwidth, except the second bandwidth, of the linear prediction residual signal, and correspondingly, encoding the spectral envelope of the linear prediction residual signal includes encoding the spectral detail of the second bandwidth of the linear prediction residual signal.

A second aspect of the embodiments of the present disclosure provides a linear prediction-based comfort noise signal generation method, where the method includes receiving a bitstream, and decoding the bitstream to obtain a spectral detail and a linear prediction coefficient, where the spectral detail indicates a spectral envelope of a linear prediction excitation signal, obtaining the linear prediction excitation signal according to the spectral detail, and obtaining a comfort noise signal according to the linear prediction coefficient and the linear prediction excitation signal.

According to the noise signal generation method in this embodiment of the present disclosure, more spectral details of an original background noise signal can be recovered such that comfort noise can be closer to original background noise in terms of subjective auditory perception of a user, and subjective perception quality of the user is improved.

With reference to the second aspect of the embodiment of the present disclosure, in a first possible implementation manner of the second aspect of the embodiment of the present disclosure, the spectral detail is the spectral envelope of the linear prediction excitation signal.

With reference to the first possible implementation manner of the second aspect of the embodiment of the present disclosure, in a second possible implementation manner of the second aspect of the embodiment of the present disclosure, the bitstream includes energy of linear prediction excitation, and before the obtaining a comfort noise signal according to the linear prediction coefficient and the linear prediction excitation signal, the method further includes obtaining a first noise excitation signal according to the energy of the linear prediction excitation, where energy of the first noise excitation signal is equal to the energy of the linear prediction excitation, and obtaining a second noise excitation signal according to the first noise excitation signal and the spectral envelope, and correspondingly, obtaining a comfort noise signal according to the linear prediction coefficient and the linear prediction excitation signal includes obtaining the comfort noise signal according to the linear prediction coefficient and the second noise excitation signal.

With reference to the second aspect of the embodiment of the present disclosure, in a third possible implementation manner of the second aspect of the embodiment of the present disclosure, the bitstream includes energy of linear prediction excitation, and before obtaining a comfort noise signal according to the linear prediction coefficient and the linear prediction excitation signal, the method further includes obtaining a first noise excitation signal according to the energy of the linear prediction excitation, where energy of the first noise excitation signal is equal to the energy of the linear prediction excitation, and obtaining a second noise excitation signal according to the first noise excitation signal and the linear prediction excitation signal, and correspondingly, obtaining a comfort noise signal according to the linear prediction coefficient and the linear prediction excitation signal includes obtaining the comfort noise signal according to the linear prediction coefficient and the second noise excitation signal.

A third aspect of the embodiments of the present disclosure provides an encoder, where the encoder includes an acquiring module configured to acquire a noise signal, and obtain a linear prediction coefficient according to the noise signal, a filter configured to filter the noise signal according to the linear prediction coefficient obtained by the acquiring module, to obtain a linear prediction residual signal, a spectral envelope generation module configured to obtain a spectral envelope of the linear prediction residual signal according to the linear prediction residual signal, and an encoding module configured to encode the spectral of the linear prediction residual signal.

According to the encoder in this embodiment of the present disclosure, more spectral details of an original background noise signal can be recovered such that comfort noise can be closer to original background noise in terms of subjective auditory perception of a user, and subjective perception quality of the user is improved.

With reference to the third aspect of the embodiment of the present disclosure, in a first possible implementation manner of the third aspect of the embodiment of the present disclosure, the encoder further includes a spectral detail generation module configured to obtain a spectral detail of the linear prediction residual signal according to the spectral envelope of the linear prediction residual signal, and correspondingly, the encoding module is further configured to encode the spectral detail of the linear prediction residual signal.

With reference to the first possible implementation manner of the third aspect of the embodiment of the present disclosure, in a second possible implementation manner of the third aspect of the embodiment of the present disclosure, the encoder further includes a residual energy calculation module configured to obtain energy of the linear prediction residual signal according to the linear prediction residual signal, and correspondingly, the encoding module is further configured to encode the linear prediction coefficient, the energy of the linear prediction residual signal, and the spectral detail of the linear prediction residual signal.

With reference to the second possible implementation manner of the third aspect of the embodiment of the present disclosure, in a third possible implementation manner of the third aspect of the embodiment of the present disclosure, the spectral detail generation module is further configured to obtain a random noise excitation signal according to the energy of the linear prediction residual signal, and use a difference between the spectral envelope of the linear prediction residual signal and a spectral envelope of the random noise excitation signal as the spectral detail of the linear prediction residual signal.

With reference to the first possible implementation manner of the third aspect of the embodiment of the present disclosure and the second possible implementation manner of the third aspect of the embodiment of the present disclosure, in a fourth possible implementation manner of the third aspect of the embodiment of the present disclosure, the spectral detail generation module includes a first-bandwidth spectral envelope generation unit configured to obtain a spectral envelope of first bandwidth according to the spectral envelope of the linear prediction residual signal, where the first bandwidth is within a bandwidth range of the linear prediction residual signal, and a spectral detail calculation unit configured to obtain the spectral detail of the linear prediction residual signal according to the spectral envelope of the first bandwidth.

With reference to the fourth possible implementation manner of the third aspect of the embodiment of the present disclosure, in a fifth possible implementation manner of the third aspect of the embodiment of the present disclosure, the first-bandwidth spectral envelope generation unit is further configured to calculate a spectral structure of the linear prediction residual signal, and use a spectrum of a first part of the linear prediction residual signal as the spectral envelope of the first bandwidth, where a spectral structure of the first part is stronger than a spectral structure of another part, except the first part, of the linear prediction residual signal.

With reference to the fifth possible implementation manner of the third aspect of the embodiment of the present disclosure, in a sixth possible implementation manner of the third aspect of the embodiment of the present disclosure, the first-bandwidth spectral envelope generation unit calculates the spectral structure of the linear prediction residual signal in one of the following manners calculating the spectral structure of the linear prediction residual signal according to a spectral envelope of the noise signal, and calculating the spectral structure of the linear prediction residual signal according to the spectral envelope of the linear prediction residual signal.

With reference to the first possible implementation manner of the third aspect of the embodiment of the present disclosure, in a seventh possible implementation manner of the third aspect of the embodiment of the present disclosure, the spectral detail generation module is further configured to obtain the spectral detail of the linear prediction residual signal according to the spectral envelope of the linear prediction residual signal, calculate a spectral structure of the linear prediction residual signal according to the spectral detail of the linear prediction residual signal, and obtain a spectral detail of second bandwidth of the linear prediction residual signal according to the spectral structure, where the second bandwidth is within a bandwidth range of the linear prediction residual signal, and a spectral structure of the second bandwidth is stronger than a spectral structure of another part of bandwidth, except the second bandwidth, of the linear prediction residual signal, and correspondingly, the encoding module is further configured to encode the spectral detail of the second bandwidth of the linear prediction residual signal.

A fourth aspect of the embodiments of the present disclosure provides a decoder, where the decoder includes a receiving module configured to receive a bitstream, and decode the bitstream to obtain a spectral detail and a linear prediction coefficient, where the spectral detail indicates a spectral envelope of a linear prediction excitation signal, a linear prediction excitation signal generation module configured to obtain the linear prediction excitation signal according to the spectral detail, and a comfort noise signal generation module configured to obtain a comfort noise signal according to the linear prediction coefficient and the linear prediction excitation signal.

According to the decoder in this embodiment of the present disclosure, more spectral details of an original background noise signal can be recovered such that comfort noise can be closer to original background noise in terms of subjective auditory perception of a user, and subjective perception quality of the user is improved.

With reference to the fourth aspect of the embodiment of the present disclosure, in a first possible implementation manner of the fourth aspect of the embodiment of the present disclosure, the spectral detail is the spectral envelope of the linear prediction excitation signal.

With reference to the first possible implementation manner of the second aspect of the embodiment of the present disclosure, in a second possible implementation manner of the second aspect of the embodiment of the present disclosure, the bitstream includes energy of linear prediction excitation, and before the obtaining a comfort noise signal according to the linear prediction coefficient and the linear prediction excitation signal, the method further includes obtaining a first noise excitation signal according to the energy of the linear prediction excitation, where energy of the first noise excitation signal is equal to the energy of the linear prediction excitation, and obtaining a second noise excitation signal according to the first noise excitation signal and the spectral envelope, and correspondingly, obtaining a comfort noise signal according to the linear prediction coefficient and the linear prediction excitation signal includes obtaining the comfort noise signal according to the linear prediction coefficient and the second noise excitation signal.

With reference to the fourth aspect of the embodiment of the present disclosure, in a third possible implementation manner of the fourth aspect of the embodiment of the present disclosure, the bitstream includes energy of linear prediction excitation, and the decoder further includes a first noise excitation signal generation module configured to obtain a first noise excitation signal according to the energy of the linear prediction excitation, where energy of the first noise excitation signal is equal to the energy of the linear prediction excitation, and a second noise excitation signal generation module configured to obtain a second noise excitation signal according to the first noise excitation signal and the linear prediction excitation signal, and correspondingly, the comfort noise signal generation module is further configured to obtain the comfort noise signal according to the linear prediction coefficient and the second noise excitation signal.

A fifth aspect of the embodiments of the present disclosure provides an encoding and decoding system, where the encoding and decoding system includes the encoder according to any one of embodiments of the third aspect of the present disclosure, and the decoder according to any one of embodiments of the fourth aspect of the present disclosure.

According to the encoding and decoding system in this embodiment of the present disclosure, more spectral details of an original background noise signal can be recovered such that comfort noise can be closer to original background noise in terms of subjective auditory perception of a user, and subjective perception quality of the user is improved.

BRIEF DESCRIPTION OF DRAWINGS

To describe the technical solutions in some of the embodiments of the present disclosure more clearly, the following briefly describes the accompanying drawings that describing some of the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are merely a part rather than all of the embodiments of the present disclosure. All other embodiments obtained by a person of ordinary skill in the art based on the embodiments of the present disclosure without creative efforts shall fall within the protection scope of the present disclosure.

Figure 1:
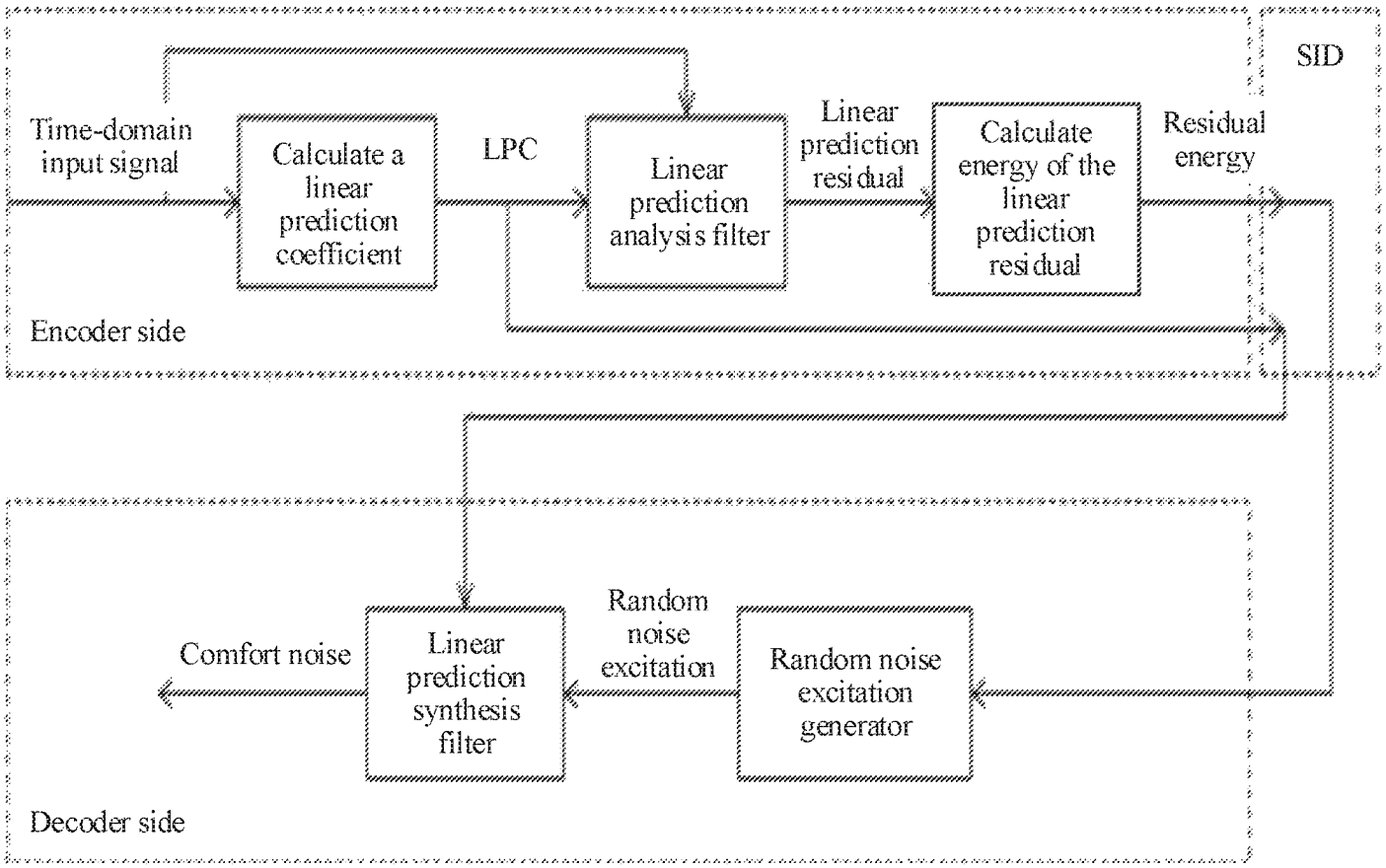
FIG. 1 is a processing flowchart of CNG.

FIG. 1 is a block diagram of a basic CNG technology that is based on a linear prediction principle. A basic idea of linear prediction is because there is a correlation between speech signal sampling points, a value of a past sampling point may be used to predict a value of a current or future sampling point, that is, sampling of a piece of speech may be approximated using a linear combination of sampling of several pieces of past speech, and a prediction coefficient is calculated by making an error between an actual speech signal sampling value and a linear prediction sampling value reach a minimum value using a mean square principle, this prediction coefficient reflects a speech signal characteristic, therefore, this group of speech characteristic parameters may be used to perform speech recognition, speech synthesis, or the like.

As shown in FIG. 1, on an encoder side, an encoder obtains a linear prediction coefficient (also referred to as LPC) according to an input time-domain background noise signal. In other approaches, multiple specific methods for acquiring the linear prediction coefficient are provided, and a relatively common method is, for example, a Levinson Durbin algorithm.

The input time-domain background noise signal is further allowed to pass through a linear prediction analysis filter, and a residual signal after the filtering, that is, a linear prediction residual, is obtained. A filter coefficient of the linear prediction analysis filter is the LPC obtained in the foregoing step. Energy of the linear prediction residual is obtained according to the linear prediction residual. To some extent, the energy of the linear prediction residual and the LPC may respectively indicate energy of the input background noise signal and a spectral envelope of the input background noise signal. The energy of the linear prediction residual and the LPC are encoded into a SID frame. Further, encoding the LPC in the SID frame is generally not a direct form for the LPC, but some transformation such as an immittance spectral pair (ISP)/ISF, and a line spectral pair (LSP)/line spectral frequency (LSF), which, however, all indicate the LPC in essence.

Correspondingly, in a specific time, SID frames received by a decoder are not consecutive. The decoder obtains decoded energy of the linear prediction residual and a decoded LPC by decoding the SID frame. The decoder uses the energy of the linear prediction residual and the LPC that are obtained by means of decoding to update energy of a linear prediction residual and an LPC that are used to generate a current comfort noise frame. The decoder may generate comfort noise using a method for using random noise excitation to excite a synthesis filter, where the random noise excitation is generated by a random noise excitation generator. Gain adjustment is generally performed on the generated random noise excitation such that energy of random noise excitation obtained after the gain adjustment is consistent with the energy of the linear prediction residual of the current comfort noise frame. A filter coefficient of the synthesis filter configured to generate the comfort noise is the LPC of the current comfort noise frame.

Figure 2:
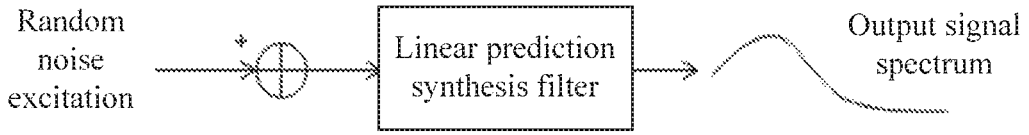
FIG. 2 is a schematic diagram of comfort noise spectrum generation.

Because the linear prediction coefficient can represent the spectral envelope of the input background noise signal to some extent, output of the linear prediction synthesis filter excited by the random noise excitation can reflect a spectral envelope of an original background noise signal to some extent. FIG. 2 shows comfort noise spectrum generation in a CNG technology.

In a linear prediction-based CNG technology, comfort noise is generated by means of random noise excitation, and a spectral envelope of the comfort noise is only a quite rough envelope that reflects original background noise. However, when the original background noise has a specific spectral structure, there is still a specific difference between the comfort noise generated by means of the linear prediction-based CNG technology and the original background noise in terms of a subjective auditory sense perception of a user.

When an encoder is transited from continuous encoding to discontinuous encoding, that is, when an active speech signal is transited to a background noise signal, several initial noise frames in a background noise segment are still encoded in a continuous encoding manner, therefore, a background noise signal recreated by a decoder has transition from high quality background noise to comfort noise. When the original background noise has a specific spectral structure, such transition may cause discomfort in the subjective auditory sense perception of the user because of a difference between the comfort noise and the original background noise. Therefore, an objective of the technical solutions of the embodiments of the present disclosure is to recover a spectral detail of an original background noise from generated comfort noise to some extent.

Figure 3:
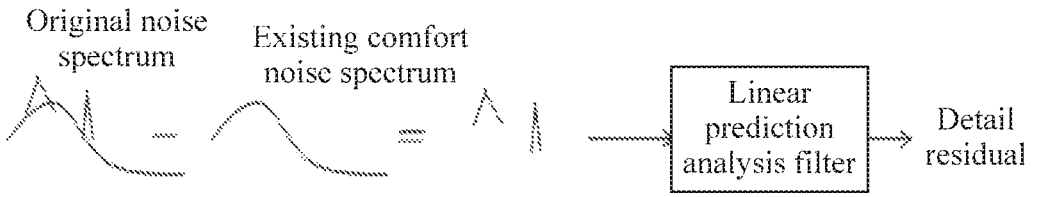
FIG. 3 is a schematic diagram of generating a spectral detail residual on an encoder side according to an embodiment of the present disclosure.
Figure 4:
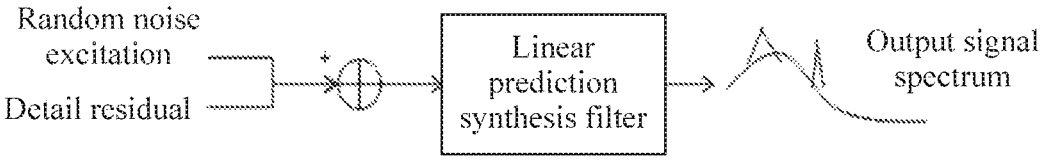
FIG. 4 is a schematic diagram of generating a comfort noise spectrum on a decoder side according to an embodiment of the present disclosure.

The following describes an entire situation of the technical solutions of the embodiments of the present disclosure with reference to FIG. 3 and FIG. 4.

As shown in FIG. 3, if an original background noise signal is compared with an initial comfort noise signal generated on a decoder side, an initial difference signal is obtained, where a spectrum of the initial difference signal represents a difference between a spectrum of the initial comfort noise signal and a spectrum of the original background noise signal. The initial difference signal is filtered by a linear prediction analysis filter, and a residual signal R is obtained.

As shown in FIG. 4, if on the decoder side, as an inverse process of the foregoing processing, the residual signal R is used as an excitation signal and is allowed to pass through a linear prediction synthesis filter, the initial difference signal may be recovered. In an embodiment of the present disclosure, if a coefficient of the linear prediction synthesis filter is completely the same as a coefficient of the analysis filter, and a residual signal R on the decoder side is the same as that on an encoder side, an obtained signal is the same as the initial difference signal. When comfort noise is to be generated, spectral detail excitation is added to existing random noise excitation, where the spectral detail excitation corresponds to the foregoing residual signal R. A sum signal of the random noise excitation and the spectral detail excitation is used as a complete excitation signal to excite the linear prediction synthesis filter, a finally obtained comfort noise signal has a spectrum that is consistent with or similar to the spectrum of the original background noise signal. In an embodiment of the present disclosure, the sum signal of the random noise excitation and the spectral detail excitation is obtained by directly superposing a time-domain signal of the random noise excitation and a time-domain signal of the spectral detail excitation, that is, performing direct addition on sampling points corresponding to a same time.

In the technical solutions of the present disclosure, a SID frame further includes spectral detail information of a linear prediction residual signal R, and the spectral detail information of the residual signal R is encoded on an encoder side and transmitted to a decoder side. The spectral detail information may be a complete spectral envelope, or may be a partial spectral envelope, or may be information about a difference between a spectral envelope and a ground envelope. The ground envelope herein may be an envelope average, or may be a spectral envelope of another signal.

On the decoder side, when creating an excitation signal used to generate comfort noise, a decoder further creates spectral detail excitation in addition to random noise excitation. Sum excitation obtained by combining the random noise excitation and the spectral detail excitation is allowed to pass through a linear prediction synthesis filter, and a comfort noise signal is obtained. Because a phase of a background noise signal generally features randomness, a phase of a spectral detail excitation signal does not need to be consistent with that of the residual signal R, as long as a spectral envelope of the spectral detail excitation signal is consistent with a spectral detail of the residual signal R.

Figure 5:
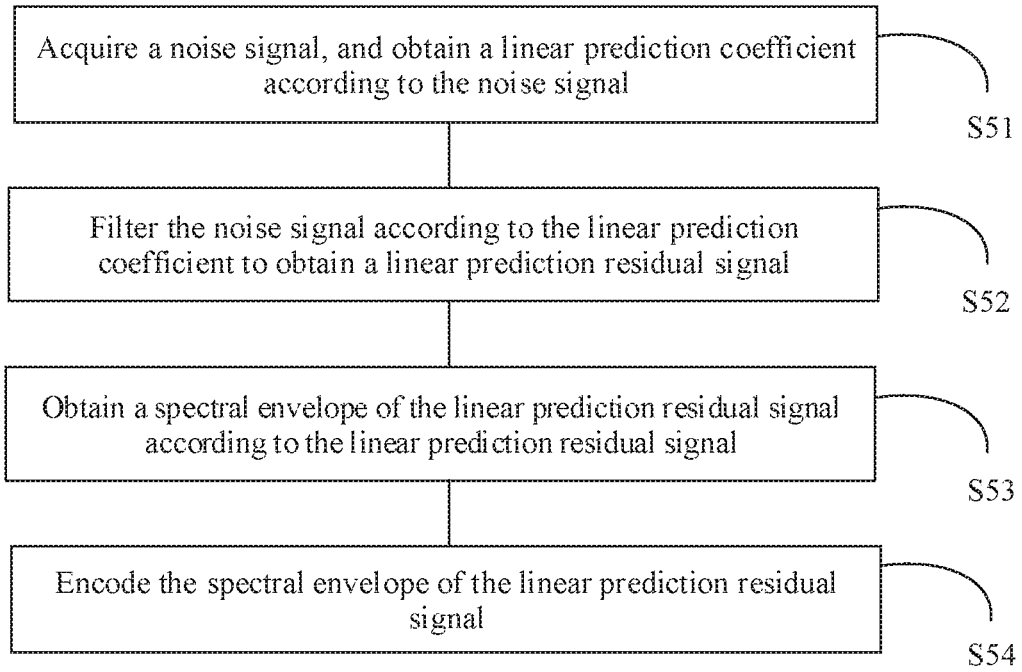
FIG. 5 is a flowchart of a linear prediction-based noise processing method according to an embodiment of the present disclosure.

The following describes a linear prediction-based noise signal processing method in an embodiment of the present disclosure with reference to FIG. 5. As shown in FIG. 5, the linear prediction-based noise signal processing method includes the following steps.

Step S51. Acquire a noise signal, and obtain a linear prediction coefficient according to the noise signal.

Multiple methods for acquiring the linear prediction coefficient are provided in the other approaches. In a specific example, a linear prediction coefficient of a noise signal frame is obtained using a Levinson-Durbin algorithm.

Step S52. Filter the noise signal according to the linear prediction coefficient to obtain a linear prediction residual signal.

The noise signal frame is allowed to pass through a linear prediction analysis filter to obtain a linear prediction residual of an audio signal frame, for a filter coefficient of the linear prediction analysis filter, reference needs to be made to the linear prediction coefficient obtained in step S51.

In an embodiment, the filter coefficient of the linear prediction analysis filter may be equal to the linear prediction coefficient calculated in step S51. In another embodiment, the filter coefficient of the linear prediction analysis filter may be a value obtained after the previously calculated linear prediction coefficient is quantized.

Step S53. Obtain a spectral envelope of the linear prediction residual signal according to the linear prediction residual signal.

In an embodiment of the present disclosure, after the spectral envelope of the linear prediction residual signal is obtained, a spectral detail of the linear prediction residual signal is obtained according to the spectral envelope of the linear prediction residual signal.

The spectral detail of the linear prediction residual signal may be indicated by a difference between the spectral envelope of the linear prediction residual and a spectral envelope of random noise excitation. The random noise excitation is local excitation generated in an encoder, and a generation manner of the random noise excitation may be consistent with a generation manner in a decoder. Generation manner consistency herein may not only indicate implementation form consistency of a random number generator, but may also indicate that random seeds of the random number generator keep synchronized.

In this embodiment of the present disclosure, the spectral detail of the linear prediction residual signal may be a complete spectral envelope, or may be a partial spectral envelope, or may be information about a difference between a spectral envelope and a ground envelope. The ground envelope herein may be an envelope average, or may be a spectral envelope of another signal.

Energy of the random noise excitation is consistent with energy of the linear prediction residual signal. In an embodiment of the present disclosure, the energy of the linear prediction residual signal may be directly obtained using the linear prediction residual signal.

In an embodiment, the spectral envelope of the linear prediction residual signal and the spectral envelope of the random noise excitation may be obtained by respectively performing fast Fourier transform (FFT) on a time-domain signal of the linear prediction residual signal and a time-domain signal of the random noise excitation.

In an embodiment of the present disclosure, that a spectral detail of the linear prediction residual signal is obtained according to the spectral envelope of the linear prediction residual signal further includes the following.

The spectral detail of the linear prediction residual signal may be indicated by a difference between the spectral envelope of the linear prediction residual signal and a spectral envelope average. The spectral envelope average may be regarded as an average spectral envelope and obtained according to the energy of the linear prediction residual signal, that is, an energy sum of envelopes in the average spectral envelope needs to be corresponding to the energy of the linear prediction residual signal.

In an embodiment of the present disclosure, that a spectral detail of the linear prediction residual signal is obtained according to the spectral envelope of the linear prediction residual signal further includes obtaining a spectral envelope of first bandwidth according to the spectral envelope of the linear prediction residual signal, where the first bandwidth is within a bandwidth range of the linear prediction residual signal, and obtaining the spectral detail of the linear prediction residual signal according to the spectral envelope of the first bandwidth.

In an embodiment of the present disclosure, the obtaining a spectral envelope of first bandwidth according to the spectral envelope of the linear prediction residual signal further includes calculating a spectral structure of the linear prediction residual signal, and using a spectrum of a first part of the linear prediction residual signal as the spectral envelope of the first bandwidth, where a spectral structure of the first part is stronger than a spectral structure of another part, except the first part, of the linear prediction residual signal.

In an embodiment of the present disclosure, the spectral structure of the linear prediction residual signal is calculated in one of the following manners of calculating the spectral structure of the linear prediction residual signal according to a spectral envelope of the noise signal, and calculating the spectral structure of the linear prediction residual signal according to the spectral envelope of the linear prediction residual signal.

In an embodiment of the present disclosure, all spectral details of the linear prediction residual signal may be calculated first, and then the spectral structure of the linear prediction residual signal is calculated according to the spectral details of the linear prediction residual signal. During encoding in step S54, some spectral details may be encoded according to the spectral structure. In a specific embodiment, only a spectral detail with a strongest structure may be encoded. For a specific calculation manner, reference may be made to another related embodiment of the present disclosure and another manner that a person of ordinary skill in the art can think of without creative efforts, and details are not described herein.

Step S54. Encode the spectral envelope of the linear prediction residual signal.

In an embodiment of the present disclosure, the encoding the spectral envelope of the linear prediction residual signal includes encoding the spectral detail of the linear prediction residual signal.

In an embodiment of the present disclosure, the spectral envelope of the linear prediction residual signal may be only a spectral envelope of a partial spectrum of the linear prediction residual signal. For example, in an embodiment, the spectral envelope of the linear prediction residual signal may be a spectral envelope of only a low-frequency part of the linear prediction residual signal.

In an embodiment, a parameter encoded into a bitstream may be only a parameter that represents a current frame. However, in another embodiment, the parameter encoded into the bitstream may be a smoothed value such as an average, a weighted average, or a moving average of each parameter in several frames. According to the linear prediction-based noise signal processing method in this embodiment of the present disclosure, more spectral details of an original background noise signal can be recovered such that comfort noise is closer to original background noise in terms of subjective auditory perception of a user, a "switching sense" caused when continuous transmission is transited to DTX is relieved, and subjective perception quality of the user is improved.

Figure 6:
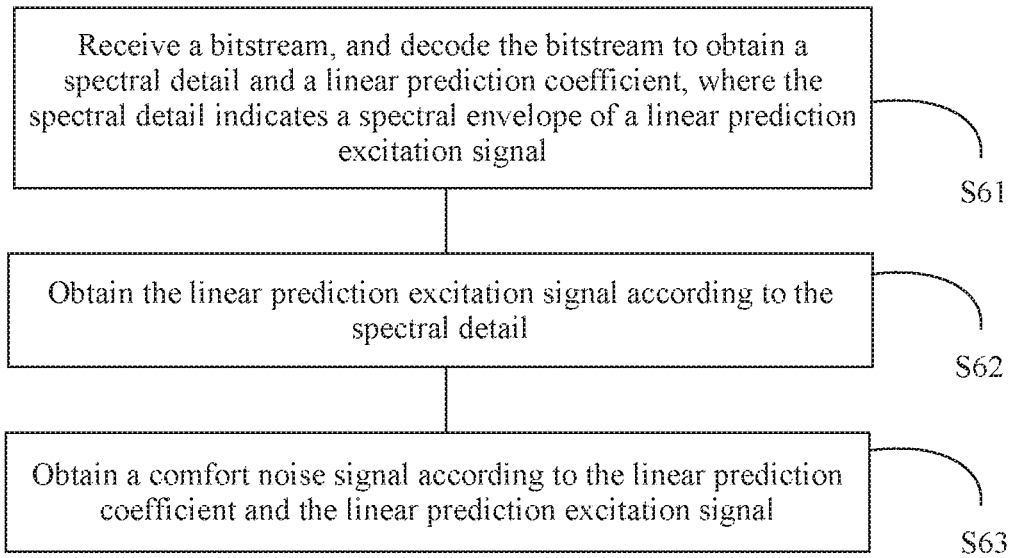
FIG. 6 is a flowchart of a CNG method according to an embodiment of the present disclosure.

The following describes a linear prediction-based comfort noise signal generation method according to an embodiment of the present disclosure with reference to FIG. 6. As shown in FIG. 6, the linear prediction-based comfort noise signal generation method in this embodiment of the present disclosure includes the following steps.

Step S61. Receive a bitstream, and decode the bitstream to obtain a spectral detail and a linear prediction coefficient, where the spectral detail indicates a spectral envelope of a linear prediction excitation signal.

In an embodiment of the present disclosure, the spectral detail may be consistent with the spectral envelope of the linear prediction excitation signal.

Step S62. Obtain the linear prediction excitation signal according to the spectral detail.

In an embodiment of the present disclosure, when the spectral detail is the spectral envelope of the linear prediction excitation signal, the linear prediction excitation signal may be obtained according to the spectral envelope of the linear prediction excitation signal.

Step S63. Obtain a comfort noise signal according to the linear prediction coefficient and the linear prediction excitation signal.

In an embodiment of the present disclosure, the bitstream includes energy of linear prediction excitation, and before obtaining a comfort noise signal according to the linear prediction coefficient and the linear prediction excitation signal, the method further includes obtaining a first noise excitation signal according to the energy of the linear prediction excitation, where energy of the first noise excitation signal is equal to the energy of the linear prediction excitation, and obtaining a second noise excitation signal according to the first noise excitation signal and the linear prediction excitation signal.

Correspondingly, obtaining a comfort noise signal according to the linear prediction coefficient and the linear prediction excitation signal further includes obtaining the comfort noise signal according to the linear prediction coefficient and the second noise excitation signal.

In an embodiment of the present disclosure, when the received spectral detail is consistent with the spectral envelope of the linear prediction excitation signal, the bitstream received by a decoder side may include energy of linear prediction excitation.

A first noise excitation signal is obtained according to the energy of the linear prediction excitation, where energy of the first noise excitation signal is equal to the energy of the linear prediction excitation.

A second noise excitation signal is obtained according to the first noise excitation signal and the spectral envelope.

Correspondingly, obtaining a comfort noise signal according to the linear prediction coefficient and the linear prediction excitation signal further includes obtaining the comfort noise signal according to the linear prediction coefficient and the second noise excitation signal.

In an embodiment of the present disclosure, when receiving the bitstream, a decoder decodes the bitstream and obtains a decoded linear prediction coefficient, decoded energy of linear prediction excitation, and a decoded spectral detail.

Random noise excitation is created according to energy of a linear prediction residual. A specific method is first generating a group of random number sequences using a random number generator, and performing gain adjustment on the random number sequence such that energy of an adjusted random number sequence is consistent with the energy of the linear prediction residual. The adjusted random number sequence is the random noise excitation.

Spectral detail excitation is created according to the spectral detail. A basic method is performing gain adjustment on a sequence of FFT coefficients with a randomized phase using the spectral detail such that a spectral envelope corresponding to an FFT coefficient obtained after the gain adjustment is consistent with the spectral detail. Finally, the spectral detail excitation is obtained by means of inverse FFT (IFFT).

In an embodiment of the present disclosure, a specific creating method is generating a random number sequence of N points using a random number generator, and using the random number sequence of N points as a sequence of FFT coefficients with a randomized phase and randomized amplitude. An FFT coefficient obtained after the gain adjustment is transformed to a time-domain signal by means of the IFFT transform, that is, the spectral detail excitation. The random noise excitation is combined with the spectral detail excitation, and complete excitation is obtained.

Finally, the complete excitation is used to excite a linear prediction synthesis filter, and a comfort noise frame is obtained, where a coefficient of the synthesis filter is the linear prediction coefficient.

Figure 7:
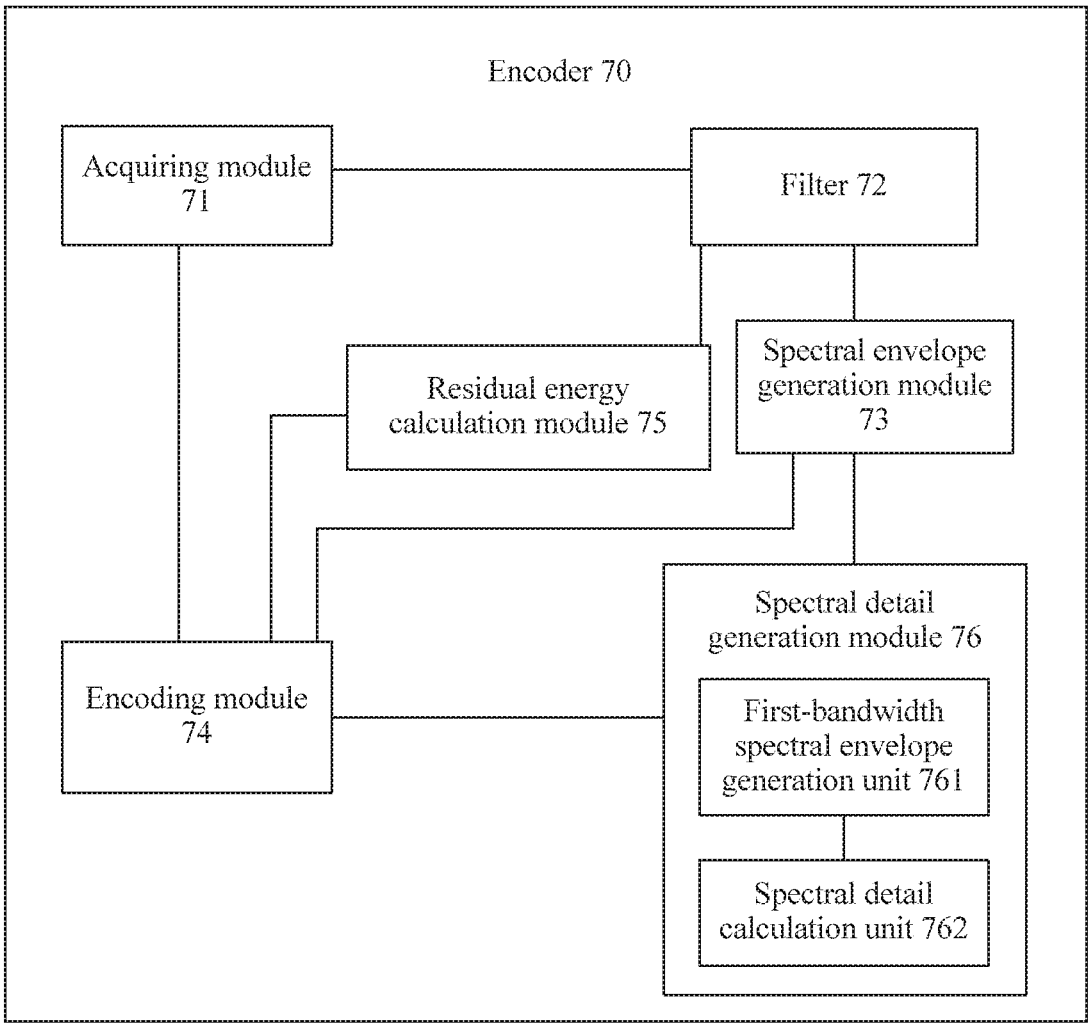
FIG. 7 is a structural diagram of an encoder according to an embodiment of the present disclosure.

The following describes an encoder 70 with reference to FIG. 7. As shown in FIG. 7, the encoder 70 includes an acquiring module 71 configured to acquire a noise signal, and obtain a linear prediction coefficient according to the noise signal, a filter 72, connected to the acquiring module 71 and configured to filter the noise signal according to the linear prediction coefficient obtained by the acquiring module 71 to obtain a linear prediction residual signal, a spectral envelope generation module 73 connected to the filter 72 and configured to obtain a spectral envelope of the linear prediction residual signal according to the linear prediction residual signal, and an encoding module 74 connected to the spectral envelope generation module 73 and configured to encode the spectral envelope of the linear prediction residual signal.

In an embodiment of the present disclosure, the encoder 70 further includes a spectral detail generation module 76, where the spectral detail generation module 76 is connected to the encoding module 74 and the spectral envelope generation module 73, and is configured to obtain a spectral detail of the linear prediction residual signal according to the spectral envelope of the linear prediction residual signal.

Correspondingly, the encoding module 74 is further configured to encode the spectral detail of the linear prediction residual signal.

In an embodiment of the present disclosure, the encoder 70 further includes a residual energy calculation module 75 connected to the filter 72 and configured to obtain energy of the linear prediction residual signal according to the linear prediction residual signal.

Correspondingly, the encoding module 74 is further configured to encode the linear prediction coefficient, the energy of the linear prediction residual signal, and the spectral detail of the linear prediction residual signal.

In an embodiment of the present disclosure, the spectral detail generation module 76 is further configured to obtain a random noise excitation signal according to the energy of the linear prediction residual signal, and use a difference between the spectral envelope of the linear prediction residual signal and a spectral envelope of the random noise excitation signal as the spectral detail of the linear prediction residual signal.

In an embodiment of the present disclosure, the spectral detail generation module 76 includes a first-bandwidth spectral envelope generation unit 761 configured to obtain a spectral envelope of first bandwidth according to the spectral envelope of the linear prediction residual signal, where the first bandwidth is within a bandwidth range of the linear prediction residual signal, and a spectral detail calculation unit 762 configured to obtain the spectral detail of the linear prediction residual signal according to the spectral envelope of the first bandwidth.

In an embodiment of the present disclosure, the first-bandwidth spectral envelope generation unit 761 is further configured to calculate a spectral structure of the linear prediction residual signal, and use a spectrum of a first part of the linear prediction residual signal as the spectral envelope of the first bandwidth, where a spectral structure of the first part is stronger than a spectral structure of another part, except the first part, of the linear prediction residual signal.

In an embodiment of the present disclosure, the first-bandwidth spectral envelope generation unit 761 calculates the spectral structure of the linear prediction residual signal in one of the following manners of calculating the spectral structure of the linear prediction residual signal according to a spectral envelope of the noise signal, and calculating the spectral structure of the linear prediction residual signal according to the spectral envelope of the linear prediction residual signal.

Figure 10:
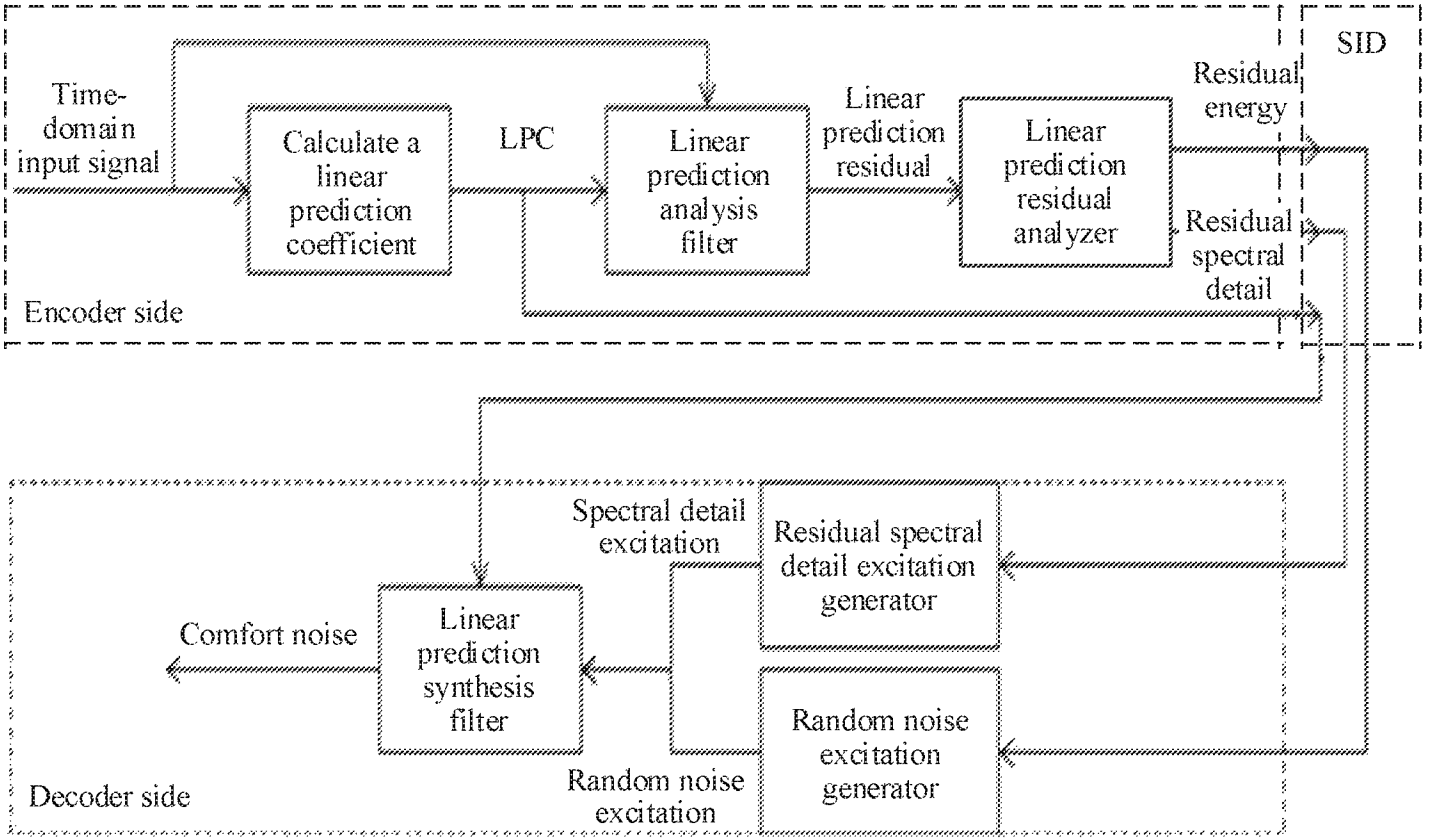
FIG. 10 is a schematic diagram of a complete procedure from an encoder side to a decode side according to an embodiment of the present disclosure.
Figure 11:
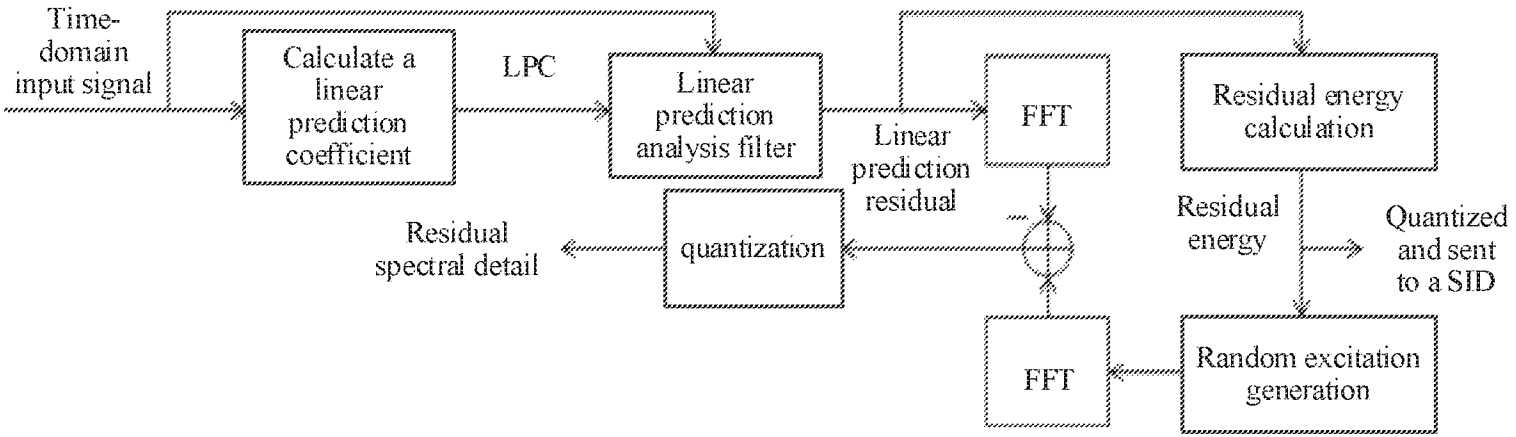
FIG. 11 is a schematic diagram of obtaining a residual spectral detail on an encoder side according to an embodiment of the present disclosure.

It may be understood that, for a working procedure of the encoder 70, reference may be further made to the method embodiment in FIG. 5 and embodiments of an encoder side in FIG. 10 and FIG. 11, details are not described herein.

Figure 8:
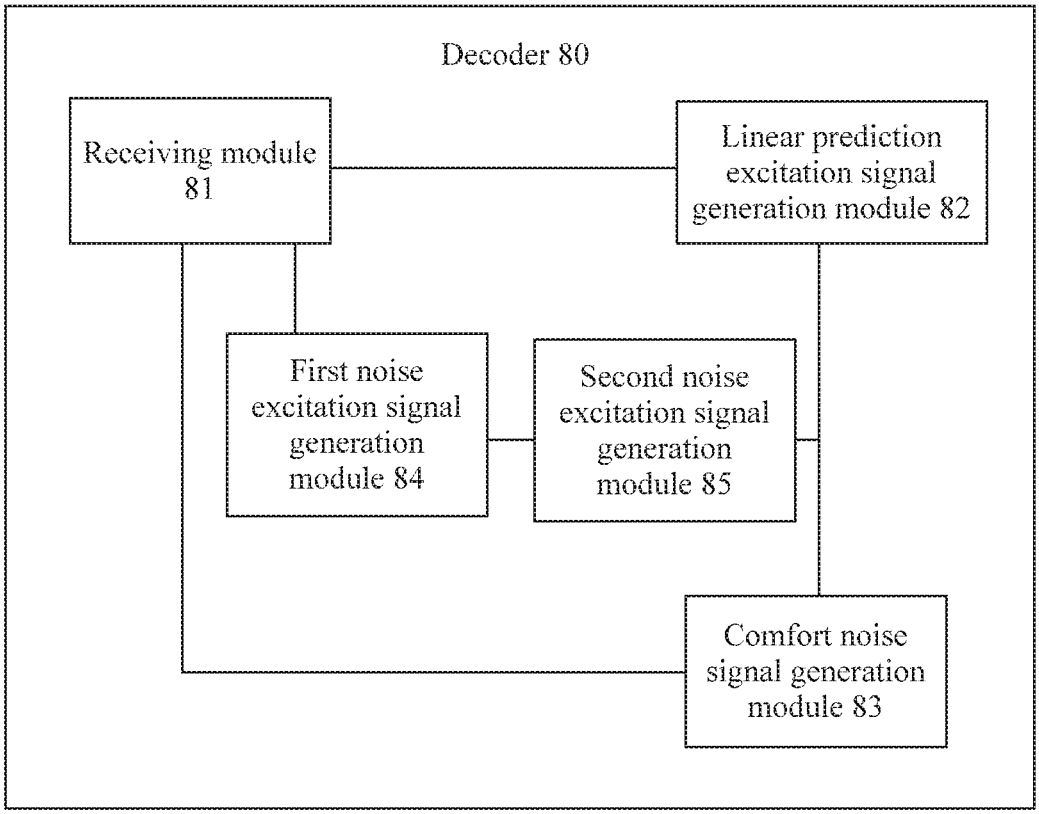
FIG. 8 is a structural diagram of a decoder according to an embodiment of the present disclosure.

The following describes a decoder 80 with reference to FIG. 8. As shown in FIG. 8, the decoder 80 includes a receiving module 81, a linear prediction excitation signal generation module 82, and a comfort noise signal generation module 83.

The receiving module 81 is configured to receive a bitstream, and decode the bitstream to obtain a spectral detail and a linear prediction coefficient, where the spectral detail indicates a spectral envelope of a linear prediction excitation signal.

In an embodiment of the present disclosure, the spectral detail is the spectral envelope of the linear prediction excitation signal.

The linear prediction excitation signal generation module 82 is connected to the receiving module 81, and is configured to obtain the linear prediction excitation signal according to the spectral detail.

The comfort noise signal generation module 83 is connected to the receiving module 81 and the linear prediction excitation signal generation module 82, and is configured to obtain a comfort noise signal according to the linear prediction coefficient and the linear prediction excitation signal.

In an embodiment of the present disclosure, the bitstream includes energy of a linear prediction excitation, and the decoder 80 further includes a first noise excitation signal generation module 84 connected to the receiving module 81 and configured to obtain a first noise excitation signal according to the energy of the linear prediction excitation, where energy of the first noise excitation signal is equal to the energy of the linear prediction excitation, and a second noise excitation signal generation module 85 connected to the linear prediction excitation signal generation module 82 and the first noise excitation signal generation module 84, and configured to obtain a second noise excitation signal according to the first noise excitation signal and the linear prediction excitation signal.

Correspondingly, the comfort noise signal generation module 83 is further configured to obtain the comfort noise signal according to the linear prediction coefficient and the second noise excitation signal.

It may be understood that, for a working procedure of the decoder 80, reference may be further made to the method embodiment in FIG. 6 and an embodiment of a decoder side in FIG. 10, details are not described herein.

Figure 9:
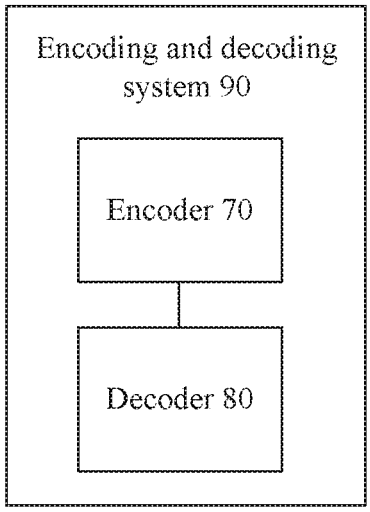
FIG. 9 is a structural diagram of an encoding and decoding system according to an embodiment of the present disclosure.

The following describes an encoding and decoding system 90 with reference to FIG. 9. As shown in FIG. 9, the encoding and decoding system 90 includes an encoder 70 and a decoder 80. For specific working procedures of the encoder 70 and the decoder 80, reference may be made to other embodiments of the present disclosure.

FIG. 10 shows a technical block diagram that describes a CNG technology in the technical solutions of the present disclosure.

As shown in FIG. 10, in a specific embodiment of an encoder, a linear prediction coefficient lpc(k) of an audio signal frame s(i) is obtained using a Levinson-Durbin algorithm, where i=0, 1, . . . , N−1, k=0, 1, . . . , M−1, N indicates a quantity of time-domain sampling points of the audio signal frame, and M indicates a linear prediction order. The audio signal frame s(i) is allowed to pass through a linear prediction analysis filter A(Z) to obtain a linear prediction residual R(i) of the audio signal frame, where i=0, 1, . . . , N−1, a filter coefficient of the linear prediction analysis filter A(Z) is lpc(k), and k=0, 1, . . . , M−1.

In an embodiment, the filter coefficient of the linear prediction analysis filter A(Z) may be equal to the previously calculated linear prediction coefficient lpc(k) of the audio signal frame s(i). In another embodiment, the filter coefficient of the linear prediction analysis filter A(Z) may be a value obtained after the previously calculated linear prediction coefficient lpc(k) of the audio signal frame s(i) is quantized. For brief description, lpc(k) is uniformly used herein to indicate the filter coefficient of the linear prediction analysis filter A(Z).

A process of obtaining the linear prediction residual R(i) may be expressed as follows:

$$R(i) = \sum_{k=0}^{M-1} lpc(k) \cdot s(i-k),$$

where lpc(k) indicates the filter coefficient of the linear prediction analysis filter A(Z), M indicates the quantity of time-domain sampling points of the audio signal frame, K is a natural number, and s(i−k) indicates the audio signal frame.

In an embodiment, energy $E_R$ of the linear prediction residual may be directly obtained using the linear prediction residual R(i). In this case:

$$E_R = \sum_{i=0}^{N-1} s^2(i),$$

where s(i) is the audio signal frame, and N indicates the quantity of time-domain sampling points of the linear prediction residual.

Spectral detail information of the linear prediction residual R(i) may be indicated by a difference between a spectral envelope of the linear prediction residual R(i) and a spectral envelope of random noise excitation $EX_R(i)$, where i=0, 1, . . . , N−1. The random noise excitation $EX_R(i)$ is local excitation generated in an encoder, and a generation manner of the random noise excitation $EX_R(i)$ may be consistent with a generation manner in a decoder. Energy of $EX_R(i)$ is $E_R$. Generation manner consistency herein may not only indicate implementation form consistency of a random number generator, but may also indicate that random seeds of the random number generator keep synchronized. In an embodiment, the spectral envelope of the linear prediction residual R(i) and the spectral envelope of the random noise excitation $EX_R(i)$ may be obtained by respectively performing FFT on a time-domain signal of the linear prediction residual R(i) and a time-domain signal of the random noise excitation $EX_R(i)$.

In this embodiment of the present disclosure, because the random noise excitation is generated on an encoder side, the energy of the random noise excitation may be controlled. Herein, the energy of the generated random noise excitation needs to be equal to the energy of the linear prediction residual. For brevity herein, $E_R$ is still used to indicate the energy of the random noise excitation.

In an embodiment of the present disclosure, SR(j) is used to indicate the spectral envelope of the linear prediction residual R(i), and $SX_R(j)$ is used to indicate the spectral envelope of the random noise excitation $EX_R(i)$, where j=0, 1, . . . , K−1, and K is a quantity of spectral envelopes. In this case:

$$SR(j) = \frac{1}{h(j) - l(j) + 1} \cdot \sum_{m=l(j)}^{h(j)} B_R(m), \text{ and}$$

$$SX_R(j) = \frac{1}{h(j) - l(j) + 1} \cdot \sum_{m=l(j)}^{h(j)} B_{XR}(m),$$

where $B_R(m)$ and $B_{XR}$ (m) respectively indicate an FFT energy spectrum of the linear prediction residual and an FFT energy spectrum of the random noise excitation, m indicates the $m^{th}$ FFT frequency bin, and h(j) and 1(*j*) respectively indicate FFT frequency bins corresponding to an upper limit and a lower limit of the $j^{th}$ spectral envelope. Selection of the quantity K of spectral envelopes may be compromise between spectrum resolution and an encoding rate, a larger K indicates higher spectrum resolution and a larger quantity of bits that need to be encoded, otherwise, a smaller K indicates lower spectrum resolution and a smaller quantity of bits that need to be encoded. A spectral detail $S_D(j)$ of the linear prediction residual R(i) is obtained using a difference between SR(j) and $SX_R(j)$. When encoding a SID frame, the encoder separately quantizes the linear prediction coefficient lpc(k), the energy $E_R$ of the linear prediction residual, and the spectral detail $S_D(j)$ of the linear prediction residual, where quantization of the linear prediction coefficient lpc(k) is generally performed on an ISP/ISF domain and an LSP/LSF domain. Because a specific method for quantizing each parameter is from the other approaches, not a summary of the present disclosure, details are not described herein.

In another embodiment, spectral detail information of the linear prediction residual R(i) may be indicated by a difference between a spectral envelope of the linear prediction residual R(i) and a spectral envelope average. SR(j) is used to indicate the spectral envelope of the linear prediction residual R(i), and SM(j) is used to indicate the spectral envelope average or an average spectral envelope, where j=0, 1, . . . , K−1, and K is a quantity of spectral envelopes. In this case:

$$SR(j) = \frac{1}{h(j) - l(j) + 1} \cdot \sum_{m=l(j)}^{h(j)} E_R(m), \text{ and}$$

$$SM(j) = E_R/K,\ j = 0, 1, \ldots K-1,$$

where $E_R(m)$ indicates an FFT energy spectrum of the linear prediction residual, m indicates the $m^{th}$ FFT frequency bin, and h(j) and l(*j*) respectively indicate FFT frequency bins corresponding to an upper limit and a lower limit of the $j^{th}$ spectral envelope. SM(j) indicates the spectral envelope average or the average spectral envelope, and $E_R$ is energy of the linear prediction residual.

In an embodiment, a parameter encoded into a SID frame may be only a parameter that represents a current frame. However, in another embodiment, the parameter encoded into the SID frame may be a smoothed value such as an average, a weighted average, or a moving average of each parameter in several frames.

As shown in FIG. 11, in the technical solution shown with reference to FIG. 10, the spectral detail $S_D(j)$ may cover all bandwidth of a signal, or may cover only partial bandwidth. In an embodiment, the spectral detail $S_D(j)$ may cover only a low frequency band of the signal, because generally, most energy of noise is at a low frequency. In another embodiment, the spectral detail $S_D(j)$ may further adaptively select bandwidth with a strongest spectral structure to cover. In this case, location information such as a starting frequency location of this frequency band needs to be encoded additionally. Spectral structure strength in the foregoing technical solution may be calculated using a linear prediction residual spectrum, or may be calculated using a difference signal between a linear prediction residual spectrum and a random noise excitation spectrum, or may be calculated using an original input signal spectrum, or may be calculated using a difference signal between an original input signal spectrum and a spectrum of a synthesis noise signal that is obtained after a random noise excitation signal excites a synthesis filter. The spectral structure strength may be calculated by various classic methods such as an entropy method, a flatness method, and a sparseness method.

It may be understood that, in this embodiment of the present disclosure, all the foregoing several methods are methods for calculating the spectral structure strength, and are independent from calculation of the spectral detail. The spectral detail may be calculated first and then the structure strength is calculated, or the structure strength is calculated first and then an appropriate frequency band is selected to acquire the spectral detail. The present disclosure sets no special limitation thereto.

For example, in an embodiment, the spectral structure strength is calculated according to the spectral envelope SR(j) of the linear prediction residual R, where j=0, 1, . . . , K−1, and K is the quantity of spectral envelopes. First, a ratio of energy of a frequency band occupied by each envelope in total energy of a frame is calculated, $$P(j) = \frac{SR(j) \cdot (h(j) - l(j) + 1)}{E_{tot}},$$

where P(j) indicates a ratio of energy of a frequency band occupied by the $j^{th}$ envelope in the total energy, SR(j) is the spectral envelope of the linear prediction residual, h(j) and l(j) respectively indicate FFT frequency bins corresponding to an upper limit and a lower limit of the $j^{th}$ spectral envelope, and $E_{tot}$ is the total energy of the frame. Entropy CR of the linear prediction residual spectrum is calculated according to P(j):

$$CR = \sum_{i=0}^{X-1} -\log(P(j)).$$

A value of the entropy CR can indicate structure strength of the linear prediction residual spectrum. A larger CR indicates a weaker spectral structure, and a smaller CR indicates a stronger spectral structure.

In an embodiment of a decoder, when receiving a SID frame, the decoder decodes the SID frame and obtains a decoded linear prediction coefficient lpc(k), decoded energy $E_R$ of a linear prediction residual, and a decoded spectral detail $S_D(j)$ of the linear prediction residual. In each background noise frame, the decoder estimates, according to these three parameters recently obtained by means of decoding, these three parameters corresponding to a current comfort noise frame. These three parameters corresponding to the current comfort noise frame are marked as a linear prediction coefficient CNlpc(k), energy $CNE_R$ of the linear prediction residual, and a spectral detail $CNS_D(j)$ of the linear prediction residual. In an embodiment, a specific estimation method may be:

$$CNlpc(k)=\alpha\cdot CNlpc(k)+(1-a)\cdot lpc(k),\ k=0,1,\ldots M-1,$$

$$CNE_R=\alpha\cdot CNE_R+(1-\alpha)\cdot E_R, \text{ and}$$

$$CNS_D(j)=\alpha\cdot CNS_D(j)+(1-\alpha)\cdot S_D(j),\ j=0,1,\ldots K-1,$$

where α is a long-term moving average coefficient or a forgetting coefficient, M is a filter order, and K is a quantity of spectral envelopes.

Random noise excitation $EX_R(i)$ is created according to the energy $CNE_R$ of the linear prediction residual. A specific method is first generating a group of random number sequences EX(i) using a random number generator, where i=0, 1, . . . , N−1, and performing gain adjustment on EX(i) such that energy of adjusted EX(i) is consistent with the energy $CNE_R$ of the linear prediction residual. The adjusted EX(i) is the random noise excitation $EX_R(i)$, and $EX_R(i)$ may be obtained with reference to the following formula:

$$EX_R(i) = \sqrt{\frac{CNE_R}{\Sigma_0^{N-1} EX^2(i)}} \cdot EX(i).$$

In addition, spectral detail excitation $EX_D(i)$ is created according to the spectral detail $CNS_D(j)$ of the linear prediction residual. A basic method is performing gain adjustment on a sequence of FFT coefficients with a randomized phase using the spectral detail $CNS_D(j)$ of the linear prediction residual such that a spectral envelope corresponding to an FFT coefficient obtained after the gain adjustment is consistent with $CNS_D(j)$, and finally obtaining the spectral detail excitation $EX_D(i)$ by means of IFFT.

In another embodiment, spectral detail excitation $EX_D(i)$ is created according to a spectral envelope of the linear prediction residual. A basic method is obtaining a spectral envelope of the random noise excitation $EX_R(i)$, and obtaining, according to the spectral envelope of the linear prediction residual, an envelope difference between the spectral envelope of the linear prediction residual and an envelope that is in the spectral envelope of the random noise excitation $EX_R(i)$ corresponding to the spectral detail excitation, performing gain adjustment on a sequence of FFT coefficients with a randomized phase using the envelope difference such that a spectral envelope corresponding to an FFT coefficient obtained after the gain adjustment is consistent with the envelope difference, and finally obtaining the spectral detail excitation $EX_D(i)$ by means of IFFT.

In an embodiment of the present disclosure, a specific method for creating $EX_D(i)$ includes generating a random number sequence of N points using a random number generator, and using the random number sequence of N points as a sequence of FFT coefficients with a randomized phase and randomized amplitude:

$$Rel(i) = RAND(\text{seed}),\ i = 0, 1, \ldots \frac{N}{2} - 1, \text{ and}$$

$$Img(i) = RAND(\text{seed}),\ i = 0, 1, \ldots \frac{N}{2} - 1.$$

Rel(i) and Img(i) in the foregoing formulas respectively indicate a real part and an imaginary part that are of the $i^{th}$ FFT frequency bin, RAND( ) indicates the random number generator, and seed is a random seed. Amplitude of a randomized FFT coefficient is adjusted according to the spectral detail $CNS_D(j)$ of the linear prediction residual, and FFT coefficients Rel'(i) and Img'(i) are obtained after gain adjustment:

$$Rel'(i) = \sqrt{\frac{E(i)}{Rel^2(i) + Img^2(i)}} \cdot Rel(i),\ i = 0, 1, \ldots \frac{N}{2} - 1, \text{ and}$$

$$Img'(i) = \sqrt{\frac{E(i)}{Rel^2(i) + Img^2(i)}} \cdot Img(i),\ i = 0, 1, \ldots \frac{N}{2} - 1,$$

where E(i) indicates energy of the $i^{th}$ FFT frequency bin obtained after the gain adjustment, and is decided by the spectral detail $CNS_D(j)$ of the linear prediction residual. A relationship between E(i) and $CNS_D(j)$ is:

$$E(i)=CNS_D(j), \text{ for } l(j)\le i\le h(j).$$

The FFT coefficients Rel'(i) and Img'(i) obtained after the gain adjustment are transformed to time-domain signals by means of IFFT transform, that is, the spectral detail excitation $EX_D(i)$. The random noise excitation $EX_R(i)$ is combined with the spectral detail excitation $EX_D(i)$, and complete excitation EX(i) is obtained from:

$$EX(i)=EX_R(i)+EX_D(i),\ i=0,1,\ldots N-1.$$

Finally, the complete excitation EX(i) is used to excite a linear prediction synthesis filter A(1/Z), and a comfort noise frame is obtained, where a coefficient of the synthesis filter is CNlpc(k).

It may be clearly understood by a person skilled in the art that, for a purpose of convenient and brief description, for specific working processes of the foregoing encoding and decoding system, encoder, decoder, modules, and units, reference may be made to corresponding processes in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented using some interfaces. The indirect couplings or communication connections between the apparatuses or units may be implemented in electronic, mechanical, or other forms.

In addition, functional units in the embodiments of the present disclosure may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present disclosure essentially, or the part contributing to the other approaches, or some of the technical solutions may be implemented in a form of a software product. The software product is stored in a storage medium, and includes several instructions for instructing a computer device (which may be a personal computer, a server, or a network device) to perform all or some of the steps of the methods described in the embodiments of the present disclosure. The foregoing storage medium includes any medium that can store program code, such as a universal serial bus (USB) flash drive, a removable hard disk, a read-only memory (ROM), a random access memory (RAM), a magnetic disk, or an optical disc.

The foregoing descriptions are merely exemplary implementation manners of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A noise signal processing method, comprising:

obtaining, by an encoder comprising a processor, a linear prediction coefficient of a noise signal;

filtering, by the encoder based on the linear prediction coefficient, a signal derived from the noise signal to obtain a linear prediction residual signal;

obtaining, by the encoder, excitation energy of the linear prediction residual signal;

obtaining, by the encoder, a frequency representation of the linear prediction residual signal;

obtaining, by the encoder, a spectral envelope based on the frequency representation; and quantizing, by the encoder, the linear prediction coefficient, the spectral envelope, and the excitation energy; and sending a quantized linear prediction coefficient, a quantized spectral envelope, and a quantized excitation energy to a silence insertion descriptor (SID) frame.

2. The noise signal processing method of claim 1, further comprising obtaining a spectral detail of the linear prediction residual signal based on the spectral envelope, and quantizing the linear prediction coefficient, the spectral envelope, and the excitation energy comprising quantizing the linear prediction coefficient, the spectral detail, and the excitation energy.

3. The noise signal processing method of claim 2, wherein obtaining the spectral detail of the linear prediction residual signal based on the spectral envelope comprises:

obtaining a random noise excitation signal according to the excitation energy of the linear prediction residual signal; and obtaining the spectral detail of the linear prediction residual signal based on the spectral envelope of the linear prediction residual signal and a spectral envelope of the random noise excitation signal.

4. The noise signal processing method of claim 2, wherein the spectral envelope is a spectral envelope of a first bandwidth, and the first bandwidth being a part of a bandwidth range of the frequency representation.

5. The noise signal processing method of claim 4, wherein the first bandwidth is a low band part of the bandwidth range of the frequency representation.

6. A comfort noise signal generating method, comprising:

decoding, by a decoder comprising a processor, a bitstream to obtain a linear prediction coefficient, excitation energy, and a residual spectral envelope;

generating, by the decoder, a first excitation signal based on the residual spectral envelope;

generating, by the decoder, a second excitation signal based on the excitation energy; and obtaining, by the decoder, a comfort noise signal based on the linear prediction coefficient, the first excitation signal, and the second excitation signal.

7. The comfort noise signal generating method of claim 6, wherein obtaining the comfort noise signal based on the linear prediction coefficient, the first excitation signal, and the second excitation signal comprises:

obtaining a final excitation signal by combining the first excitation signal and the second excitation signal; and obtaining the comfort noise signal by filtering the final excitation signal based on the linear prediction coefficient.

8. The comfort noise signal generating method of claim 6, further comprising generating, by the decoder, spectral detail excitation and random noise excitation.

9. The comfort noise signal generating method of claim 6, further comprising:

receiving, by the decoder, a bitstream; and obtaining, by the decoder, a spectral detail and the linear prediction coefficient from the bitstream, wherein the spectral detail indicates a spectral envelope of the linear prediction signal.

10. The comfort noise signal generating method of claim 6, further comprising obtaining, by the decoder, a linear prediction excitation signal according to the spectral detail.

11. An encoder, comprising:

a memory storage comprising instructions; and one or more processors in communication with the memory storage, the instructions causing the one or more processors to be configured to:

obtain a linear prediction coefficient of a noise signal;

filter, based on the linear prediction coefficient, a signal derived from the noise signal to obtain a linear prediction residual signal;

obtain excitation energy of the linear prediction residual signal;

obtain a frequency representation of the linear prediction residual signal;

obtain a spectral envelope based on the frequency representation;

quantize the linear prediction coefficient, the spectral envelope, and the excitation energy; and send a quantized linear prediction coefficient, a quantized spectral envelope, and a quantized excitation energy to a silence insertion descriptor (SID) frame.

12. The encoder of claim 11, wherein the instructions further cause the one or more processors to be configured to obtain a spectral detail of the linear prediction residual signal based on the spectral envelope, and in a manner of quantizing the linear prediction coefficient, the spectral envelope, and the excitation energy, the instructions further causing the one or more processors to be configured to quantize the linear prediction coefficient, the spectral detail, and the excitation energy.

13. The encoder of claim 12, wherein the instructions further cause the one or more processors to be configured to:

obtain a random noise excitation signal according to the excitation energy of the linear prediction residual signal; and obtain the spectral detail of the linear prediction residual signal based on the spectral envelope of the linear prediction residual signal and a spectral envelope of the random noise excitation signal.

14. The encoder of claim 12, wherein the spectral envelope is a spectral envelope of a first bandwidth, and the first bandwidth being a part of a bandwidth range of the frequency representation.

15. The encoder of claim 14, wherein the first bandwidth is a low band part of the bandwidth range of the frequency representation.

16. A decoder, comprising:

a memory storage comprising instructions; and one or more processors in communication with the memory storage, the instructions causing the one or more processors to be configured to:

decode a bitstream to obtain a linear prediction coefficient, excitation energy, and a residual spectral envelope;

generate a first excitation signal based on the residual spectral envelope;

generate a second excitation signal based on the excitation energy; and obtain a comfort noise signal based on the linear prediction coefficient, the first excitation signal, and the second excitation signal.

17. The decoder of claim 16, wherein in a manner of obtaining the comfort noise signal based on the linear prediction coefficient, the first excitation signal, and the second excitation signal, the instructions further cause the one or more processors to be configured to:

obtain a final excitation signal by combining the first excitation signal and the second excitation signal; and obtain the comfort noise signal by filtering the final excitation signal based on the linear prediction coefficient.

18. The decoder of claim 16, wherein the instructions further cause the one or more processors to be configured to generate spectral detail excitation and random noise excitation.

19. The decoder of claim 16, wherein the instructions further cause the one or more processors to be configured to:

receive a bitstream; and obtain a spectral detail and the linear prediction coefficient from the bitstream, wherein the spectral detail indicates a spectral envelope of the linear prediction signal.

20. The decoder of claim 16, wherein the instructions further cause the one or more processors to be configured to obtain a linear prediction excitation signal according to the spectral detail.

* * * * *